US010053870B2

(12) United States Patent
Yu et al.

(10) Patent No.: US 10,053,870 B2
(45) Date of Patent: Aug. 21, 2018

(54) BUILDING MATERIAL

(71) Applicant: POSCO, Pohang-Si (KR)

(72) Inventors: Young Dong Yu, Seongnam-Si (KR); Tae Yang Yoon, Seongnam-Si (KR); Pil Goo Lee, Seoul (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 15/532,265

(22) PCT Filed: Aug. 26, 2015

(86) PCT No.: PCT/KR2015/008954
§ 371 (c)(1),
(2) Date: Jun. 1, 2017

(87) PCT Pub. No.: WO2016/088986
PCT Pub. Date: Jun. 9, 2016

(65) Prior Publication Data

US 2017/0342726 A1 Nov. 30, 2017

(30) Foreign Application Priority Data

Dec. 4, 2014 (KR) ..... 10-2014-0172846

(51) Int. Cl.
*E04F 15/20* (2006.01)
*E04F 15/18* (2006.01)
(Continued)

(52) U.S. Cl.
CPC ..... *E04F 15/203* (2013.01); *E04B 1/86* (2013.01); *E04F 15/0215* (2013.01);
(Continued)

(58) Field of Classification Search
CPC ... E04F 15/203; E04F 15/0215; E04F 15/188; E04F 15/185; E04B 1/86; E04B 2001/8471
(Continued)

(56) References Cited

U.S. PATENT DOCUMENTS 3,466,222 A * 9/1969 Curtis ..... E04B 1/941 428/142
3,763,614 A * 10/1973 Hyde ..... E04D 11/02 52/309.9
(Continued)

FOREIGN PATENT DOCUMENTS

JP 51121219 3/1975
JP 5747354 10/1982
(Continued)

OTHER PUBLICATIONS

Korean Office Action—Korean Application No. 10-2014-0172846 dated Dec. 8, 2015, citing KR 10-2014-0134051, JP 06-330613, KR 20-0398609, KR 10-2004-0022032 and KR 10-1418705.
(Continued)

*Primary Examiner* — Brent W Herring
(74) *Attorney, Agent, or Firm* — Cantor Colburn LLP

(57) ABSTRACT

Provided is a building material that is disposed between an inter-floor separation layer configured to separate floors of a building having a plurality of floors from each other and a bottom layer disposed above the inter-floor separation layer. The building material includes a support member disposed between the inter-floor separation layer and the bottom layer, having a top surface of which at least a portion contacts the bottom layer, and including a protruding portion protruding downward, extending in at least one direction, and having an inner space and a plurality of damping members disposed between the inter-floor separation layer and the support member and each of which has a lower plate contacting a
(Continued)

portion of the inter-floor separation layer and an upper plate contacting a portion of the support member to allow the inter-floor separation layer to be spaced apart from the support member.

14 Claims, 7 Drawing Sheets

(51) Int. Cl.
*E04B 1/86* (2006.01)
*E04F 15/02* (2006.01)
*E04B 1/84* (2006.01)

(52) U.S. Cl.
CPC ..... *E04F 15/185* (2013.01); *E04F 15/188* (2013.01); *E04B 2001/8471* (2013.01)

(58) Field of Classification Search
USPC ..... 52/579
See application file for complete search history.

(56) References Cited

U.S. PATENT DOCUMENTS 3,845,594 A * 11/1974 Butts ..... E04B 5/29 52/334
3,945,168 A * 3/1976 Butts ..... E04B 5/29 248/351
3,979,868 A * 9/1976 Butts ..... E04B 5/29 52/334
4,441,295 A * 4/1984 Kelly ..... E04D 3/3603 52/309.8
4,449,336 A * 5/1984 Kelly ..... E04D 13/1643 52/105
4,492,064 A * 1/1985 Bynoe ..... E04D 13/172 52/309.8
4,685,259 A * 8/1987 Eberhart ..... E04F 15/18 428/118
5,027,572 A * 7/1991 Purcell ..... E04B 1/66 52/309.9
5,088,259 A * 2/1992 Myers ..... E04D 11/02 52/309.8
5,544,464 A * 8/1996 Dutil ..... E04B 5/40 52/329
5,584,153 A * 12/1996 Nunley ..... E04D 3/3602 52/309.2
5,740,647 A * 4/1998 Kelly ..... E04D 11/02 52/199
5,787,668 A * 8/1998 Carkner ..... E04D 11/02 52/302.1
5,884,446 A * 3/1999 Hageman ..... E04D 11/02 52/309.8
5,941,035 A * 8/1999 Purse ..... E04B 5/40 52/52
6,319,579 B1 11/2001 Strandgaard
7,162,847 B2 * 1/2007 Gigiakos ..... E04B 2/7453 52/582.1
7,908,810 B2 * 3/2011 Payne, Jr. ..... E04B 5/10 52/145
8,006,450 B2 * 8/2011 Cretti ..... E04B 5/026 52/320
8,245,470 B2 * 8/2012 Bathon ..... E04B 5/04 52/309.16
8,562,769 B2 * 10/2013 Kraus ..... B29C 39/18 156/292
8,726,594 B2 * 5/2014 Salazar ..... E04B 5/043 52/309.1
2003/0172600 A1 * 9/2003 Choi ..... B32B 5/32 52/144
2004/0111997 A1 * 6/2004 Gigiakos ..... E04B 2/7453 52/579
2005/0086906 A1 * 4/2005 Bathon ..... E04B 5/04 52/782.1
2005/0279434 A1 * 12/2005 Pacher ..... B60S 1/38 267/158
2006/0191232 A1 * 8/2006 Salazar ..... E04B 5/043 52/606
2007/0000198 A1 * 1/2007 Payne, Jr. ..... E04B 5/10 52/414
2008/0016803 A1 * 1/2008 Bathon ..... E04B 5/04 52/223.6
2009/0293395 A1 * 12/2009 Porter ..... E04L 31/12 52/309.1
2012/0055108 A1 * 3/2012 Bierwirth ..... E04F 15/182 52/403.1

FOREIGN PATENT DOCUMENTS

| | | |
|---|---|---|
| JP | 037468 | 2/1991 |
| JP | 06330613 | 11/1994 |
| JP | 10219900 | 8/1998 |
| JP | 2006249680 | 9/2006 |
| KR | 20040022032 | 3/2004 |
| KR | 200398609 | 10/2005 |
| KR | 20050102826 | 10/2005 |
| KR | 100624357 | 9/2006 |
| KR | 20070110630 | 11/2007 |
| KR | 100793074 | 1/2008 |
| KR | 20080108893 | 12/2008 |
| KR | 20120077213 | 7/2012 |
| KR | 101418705 | 7/2014 |
| KR | 20140134051 | 11/2014 |
| KR | 20160044687 | 4/2016 |
| KR | 20160046047 | 4/2016 |
| KR | 20160046062 | 4/2016 |
| KR | 20160049132 | 5/2016 |

OTHER PUBLICATIONS

PCT Written Opinion—PCT/KR2015/008954 dated Jun. 6, 2017, citing KR 10-2014-0134051 and KR 20-0398609.
International Search Report—PCT/KR2015/008954 dated Nov. 30, 2015.
Japanese Office Action—Japanese Application No. 2017-545838 dated Mar. 27, 2018, citing JP 03-007468, JP 57-047354, JP 51-121219, KR 10-2014-0134051, JP10-219900, JP 2006-249680, KR 20-0398609, KR 10-1418705 and US 06319579.

* cited by examiner

BUILDING MATERIAL

TECHNICAL FIELD

The present disclosure relates to a building material, and more particularly, to a building material capable of blocking or suppressing inter-floor noise of a building.

BACKGROUND ART

In general, a building having a plurality of floors, e.g. an apartment house and a skyscraper, uses flooring such as a soundproof material, a vibrationproof material, or a buffer material to block or suppress noise between floors.

For example, a glass wood insulator, an urethane foam board, expanded polystyrene foam (Styrofoam), a rock wood board, an expanded polyethylene insulating material, and a carbonized cork board are mainly used to realize a sound absorption and insulation effect of the building. Also, conventionally, a lightweight aerated concrete layer or an expanded polystyrene foam layer are used as a buffer layer to reduce inter-floor floor impact sound or enhance insulation of the apartment house or the skyscraper. However, this is not effective for sound absorption of the inter-floor floor impact sound. Accordingly, in recent years, a vibrationproof rubber pad is installed below the lightweight aerated concrete layer, or a technique for providing an air layer is suggested and realized.

However, although the rubber pad is inserted to absorb impact generated from an upper floor and vibration transmitted to a lower floor is slightly reduced in virtue of the elasticity of the rubber pad, all layers including a concrete slab layer, the rubber pad, the lightweight aerated concrete layer, and a floor finishing mortar layer are attached to each other, and thus a vibrationproof effect for the impact is reduced. Also, although the air layer is provided below the lightweight aerated concrete layer to realize a floating layer structure and reduce the inter-floor noise, the structure is complex due to its complex cross-section configuration, constructability is downgraded, and costs increase due to additional high priced material.

DISCLOSURE OF THE INVENTION

Technical Problem

The present disclosure provides a building material having a simple structure and capable of efficiently blocking or suppressing inter-floor noise of a building.

The present disclosure also provides a building material capable of being easily constructed and saving manufacturing costs.

Technical Solution

In accordance with an exemplary embodiment, a building material, which is disposed between an inter-floor separation layer configured to separate floors of a building having a plurality of floors from each other and a bottom layer disposed above the inter-floor separation layer, includes: a support member disposed between the inter-floor separation layer and the bottom layer, having a top surface of which at least a portion contacts the bottom layer, and including a protruding portion protruding downward, extending in at least one direction, and having an inner space; and a plurality of damping members disposed between the inter-floor separation layer and the support member and each of which has a lower plate contacting a portion of the inter-floor separation layer and an upper plate contacting a portion of the support member to allow the inter-floor separation layer to be spaced apart from the support member.

A plurality of buffer panels may be disposed between the support member and the inter-floor separation layer, and each of the damping members may be disposed on an edge of the buffer panel.

The damping member may include a connecting portion extending in a direction crossing a formation direction of the lower plate and the upper plate to connect the lower plate to the upper plate, and the upper plate may have a top surface contacting a portion of a bottom surface of the support member and a bottom surface spaced apart from a top surface of the buffer panel, and the connecting portion may contact a side surface of the buffer panel.

The upper plate and the lower plate of the damping member may be provided in the same direction or in the opposite direction with respect to the connecting portion, and the upper plate and the lower plate of the damping member may have the same surface area as each other within an error range.

The damping member may extend along at least one side of the buffer panel, or the damping members may be spaced apart from each other along at least one side of the buffer panel.

The protruding portion of the support member may have a height less than a distance between the support member and the buffer panel.

The damping member may have a height greater than a thickness of the buffer panel.

The support member may include a metallic material, and the damping member may include a material having a vibration-proof function.

The support member may include a steel plate, and the damping member may include vibration-proof steel containing manganese.

The building material may further include: a side buffer member vertically extending along side surfaces of the support member and the bottom layer above the inter-floor separation layer; and a washing board disposed to face the side buffer member above the bottom layer.

The side buffer member may include an air passage extending in a vertical direction and having an inner space, and the washing board may include a discharge passage communicatively connected to the air passage and connected to the outside.

The discharge passage may extend in a direction crossing an extension direction of the air passage, and the washing board may have an upper end configured to cover an upper portion of the side buffer member.

The side buffer member may have a bottom surface contacting the top surface of the buffer panel and a side surface of which at least a portion contacts the support member and the bottom layer, and the side buffer member may be made of the same material as that of the buffer panel.

The bottom layer may include a lightweight aerated concrete layer, and the lightweight aerated concrete layer may be wet-deposited on the support member and provided on the top surface and the protruding portion of the support member.

The damping member may have a height of 10 mm to 40 mm.

Advantageous Effects

In accordance with the exemplary embodiment, the building material may be disposed between the inter-floor separation layer and the bottom layer to block or suppress most of the inter-floor noise. That is, through the simple structure using the support member having a small thickness and the damping member disposed therebelow, the path through which the generated inter-floor noise is transmitted and removed may be adjusted, and accordingly, the noise may not be transmitted to the lower floor.

Also, although the generated noise is not completely removed, the noise is laterally transmitted to be discharged to the upper floor again or absorbed by the buffer panel disposed below the support member. Thus, most of the inter-floor noise may be removed.

As the above-described building material is made of a metallic material, the building material may be easily constructed and secure enough strength while installed as the thin lightweight structures.

Also, the building material in accordance with the exemplary embodiment may be mass-produced by using the manufacturing method such as roll forming or pressing, and accordingly, the building costs may be remarkably reduced. Also, the building material may serve as the mold for the layers provided thereabove. That is, since the support member serves as the mold, the lightweight aerated concrete layer and the mortar layer may be easily wet-deposited on the support member, and work interference may be removed during in-site deposition to improve the workability and the constructability.

MODE FOR CARRYING OUT THE INVENTION

Figure 1:
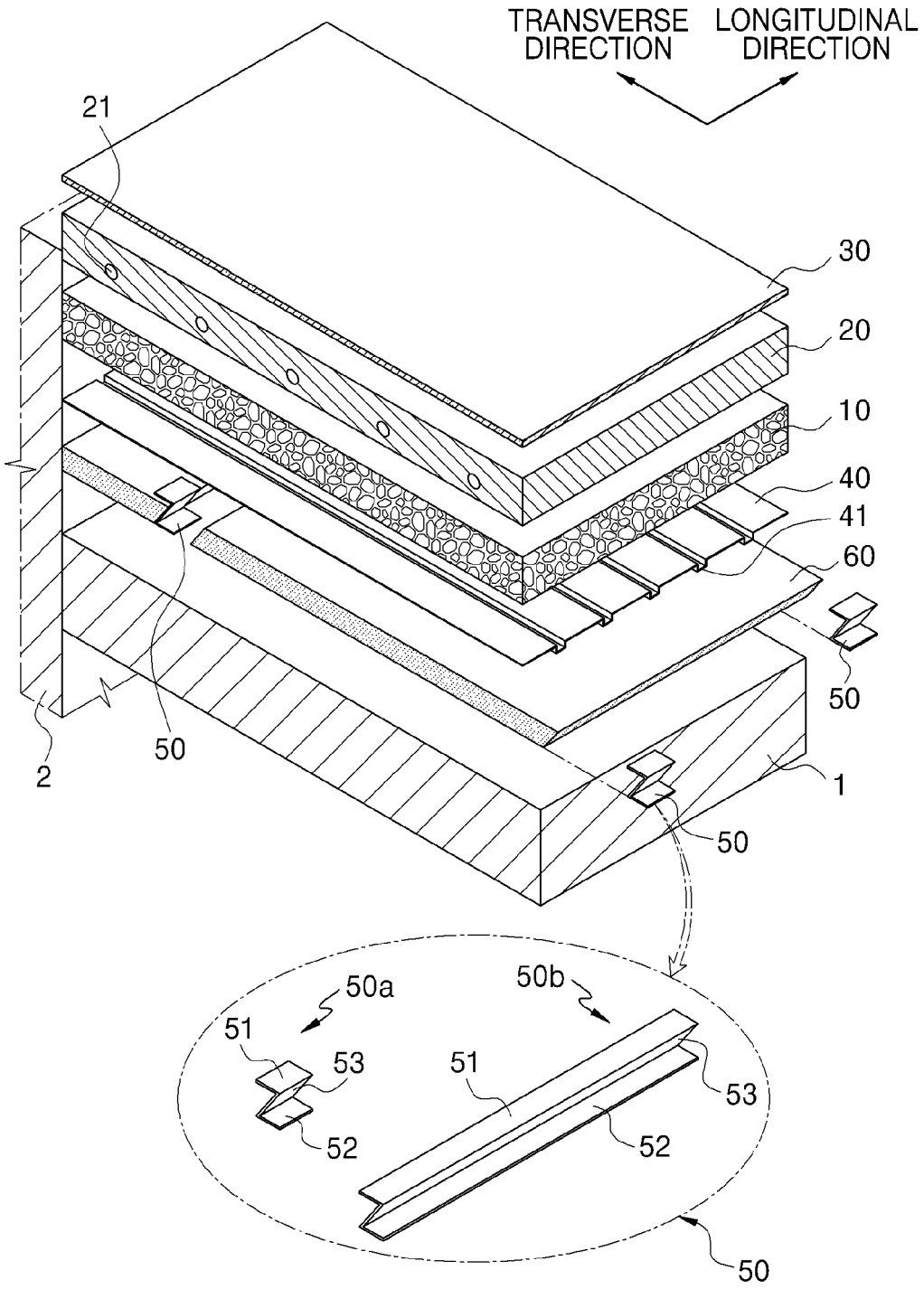
FIG. 1 is a schematic exploded perspective view illustrating a state in which building materials in accordance with an exemplary embodiment are installed in a building.

Hereinafter, specific embodiments will be described in detail with reference to the accompanying drawings. The present disclosure may, however, be embodied in many different forms and should not be construed as being limited to the embodiments set forth herein; rather, these embodiments are provided so that this disclosure will be thorough and complete, and will fully convey the concept of the invention to those skilled in the art. In the figures, the dimensions of layers and regions are exaggerated for clarity of illustration. Like reference numerals refer to like elements throughout.

Figure 2:
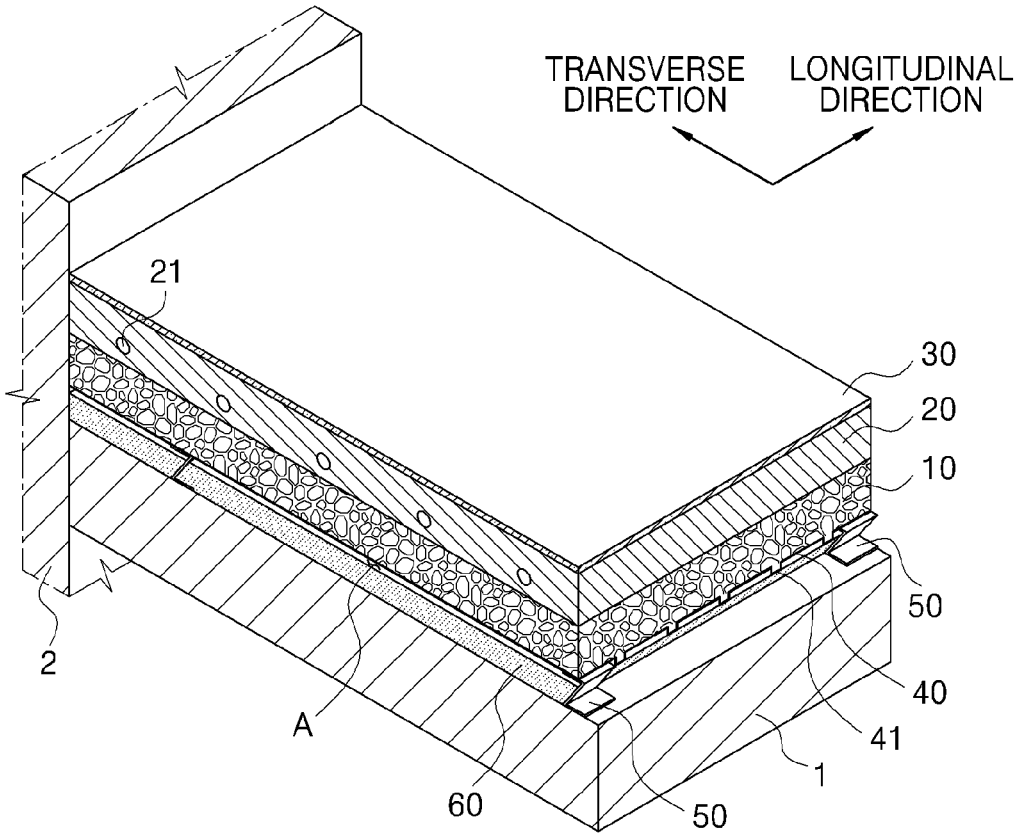
FIG. 2 is a perspective view illustrating a state in which the building materials in FIG. 1 are coupled to each other.
Figure 3:
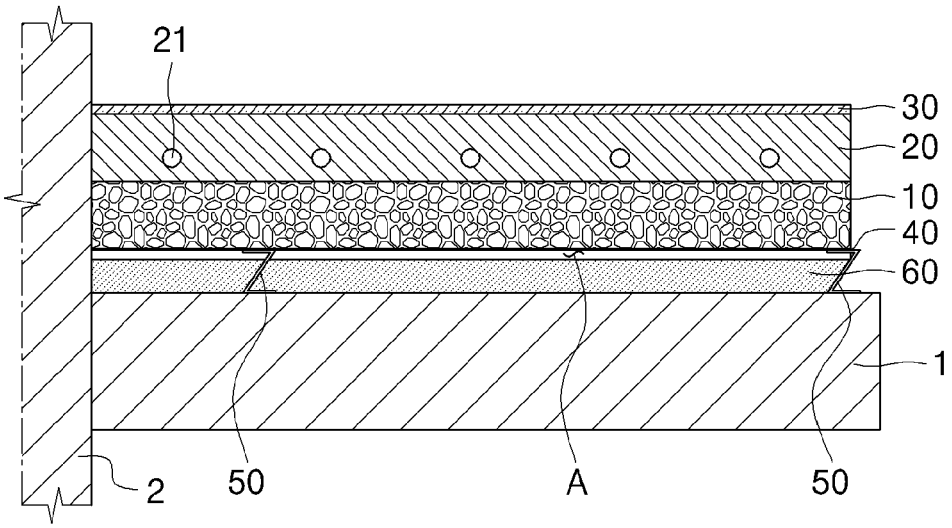
FIG. 3 is a transverse cross-sectional view of FIG. 2.
Figure 4:
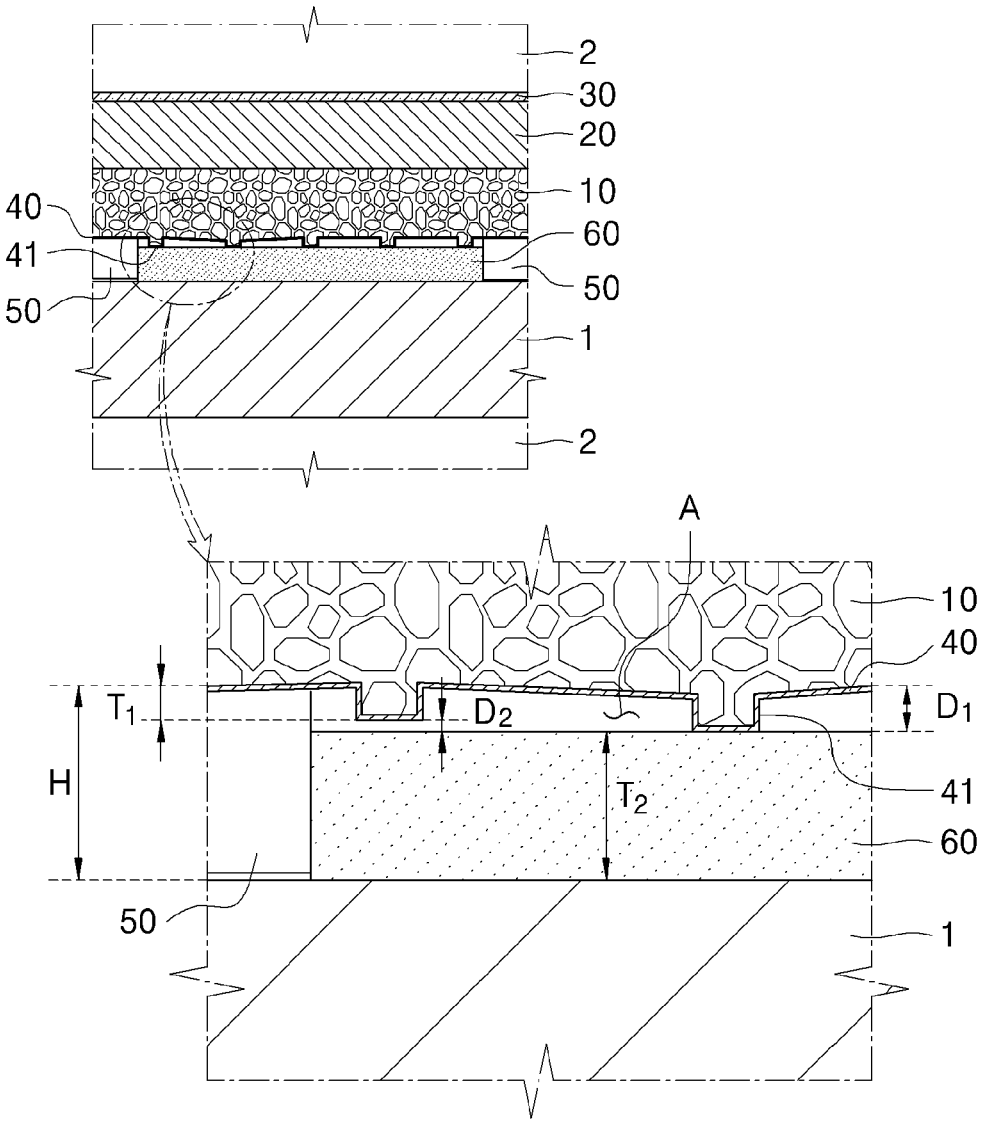
FIG. 4 is a longitudinal cross-sectional view and an expanded cross-sectional view of FIG. 2.
Figure 5:
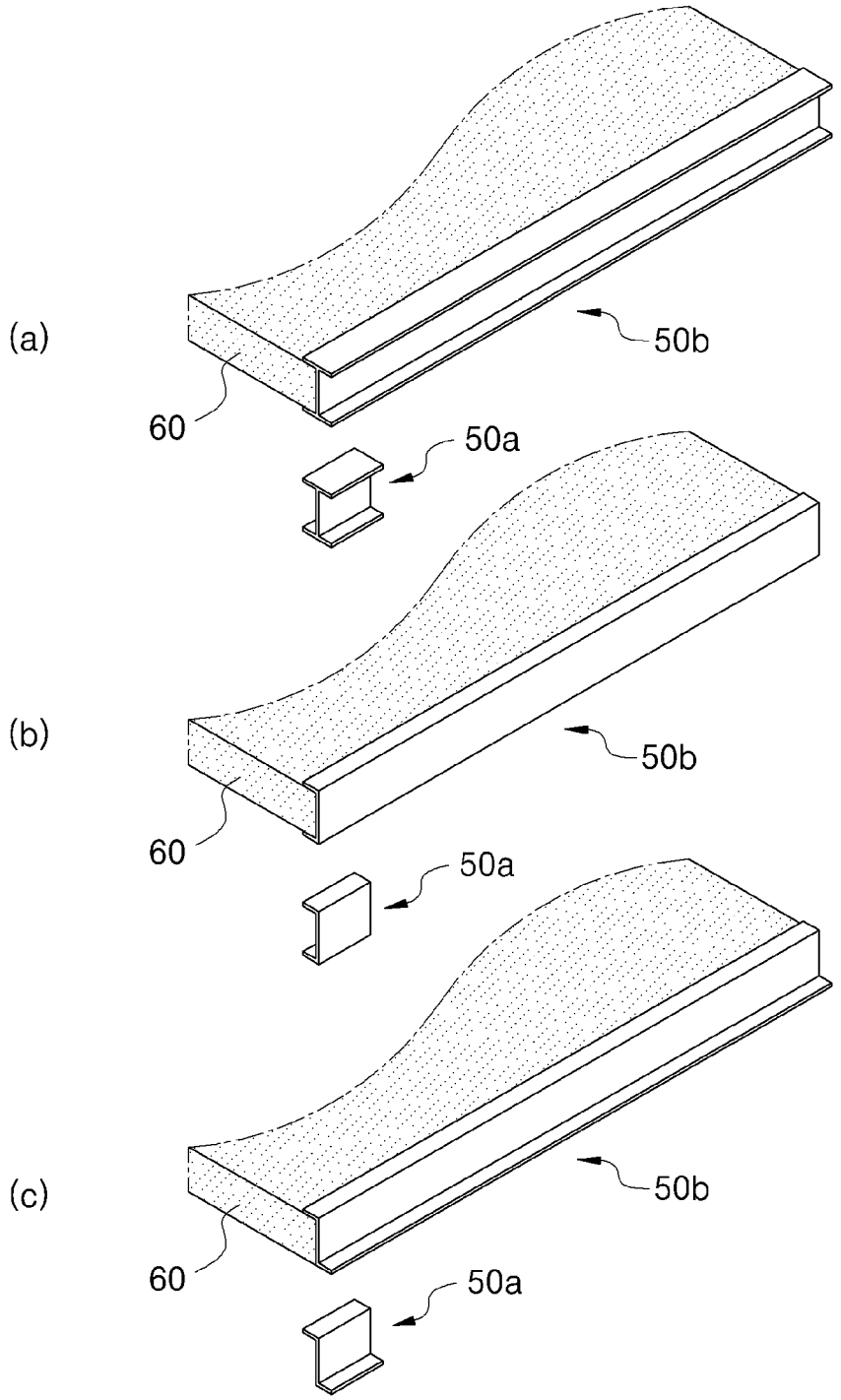
FIG. 5 is a perspective view illustrating various examples of a damping member used in an exemplary embodiment.

FIG. 1 is a schematic exploded perspective view illustrating a state in which building materials in accordance with an exemplary embodiment are installed in a building, FIG. 2 is a perspective view illustrating a state in which the building materials in FIG. 1 are coupled to each other, FIG. 3 is a transverse cross-sectional view of FIG. 2, and FIG. 4 is a longitudinal cross-sectional view and an expanded cross-sectional view of FIG. 2. Also, FIG. 5 is a perspective view illustrating various examples of a damping member used in an exemplary embodiment. The above drawings illustrate a portion of the building, on which the building material is installed.

Referring to FIGS. 1 to 4, the building material in accordance with an exemplary embodiment is disposed between an inter-floor separation layer separating layers of the building having a plurality of layers and a bottom layer disposed above the inter-floor separation layer. The building material includes a support member 40 and a plurality of damping members 50. Here, the support member 40 is disposed between the inter-floor separation layer and the bottom layer, has an upper surface of which at least a portion contacts the bottom layer, and includes a protruding portion protruding downward, extending in at least one direction, and having an inner space. Also, the plurality of damping members 50 are disposed between the inter-floor separation layer and the support member and have a lower plate contacting a portion of the inter-floor separation layer and an upper plate contacting a portion of the support member to allow the inter-floor separation layer to be spaced apart from the support member. Also, a plurality of buffer panels 60 may be disposed between the support member 40 and the inter-floor separation layer 1.

Firstly, a building includes an apartment house such as a townhouse, a multi-household house, and an apartment and a building such as a school, an office, and a shopping mall. The building also includes a structure having a plurality of floors. That is, the building represents a building having floors in a vertical direction and separated spaces divided in a horizontal direction. In such a building, spaces are divided through the inter-floor separation layer or a wall. Since noise generated from one space can be transmitted to another space, the noise between the spaces needs to be blocked. Especially, noise generated from an upper layer is transmitted to a lower layer is necessary to be blocked or suppressed.

The building includes the inter-floor separation layer 1 separating floors in the vertical direction and a wall 2 separating spaces in the horizontal direction. The inter-floor separation layer 1 extends in the horizontal direction to have a surface area corresponding to that of a first floor, separates floors, and maintains a strength of the building. For example, the inter-floor separation layer 1 may be manufactured as a ferroconcrete layer having a thickness of approximately 210 mm. However, the inter-floor separation layer 1 may be made of a different material and have various thickness as long as the floor separation and the strength are satisfied. The wall 2 extends in an up-and-down direction, i.e., a vertical direction crossing a horizontal direction and has a surface area for separating left and right spaces from each other. In addition, the wall 2 may serve as a column maintaining the inter-floor separation. The wall 2 may be manufactured of various materials according to its function.

The bottom layers 10, 20, and 30 are disposed above the inter-floor separation layer 1. The bottom layer may be disposed between people passing by the building and the inter-floor separation layer 1 and include various layers according to a desired function. For example, the bottom layer may include a lightweight aerated concrete layer 10 reducing inter-floor floor impact noise and having an insulation function, a mortar layer 20 disposed on the lightweight aerated concrete layer 10, and a finishing material layer 30. Here, the lightweight aerated concrete layer 10 may have a thickness of approximately 40 mm, the mortar layer 20 may have a thickness of approximately 40 mm, and the finishing material layer 30 may have a thickness of approximately 3 mm. Also, the mortar layer 20 may include a heating pipe 21. Besides, the bottom layer may be made of various materials, have various thicknesses, and include various functional layers.

The building material in accordance with an exemplary embodiment is disposed between the above-described inter-floor separation layer 1 and the bottom layers 10, 20, and 30. More exactly, the building material is disposed between the inter-floor separation layer 1 and the lightweight aerated concrete layer 10.

The support member 40 has a plate shape having a surface area corresponding to that of the inter-floor separation layer 1 and includes the protruding portion 41 protruding downward. That is, the support member 40 is manufactured of a kind of plate and includes the protruding portion 41 that is a groove extending in one direction and recessed downward. For example, the support member 40 may be manufactured to have a shape of a corrugated plate and a corrugated cardboard. The support member 40 may have a top surface contacting the lightweight aerated concrete layer 10, and the lightweight aerated concrete layer 10 may be inserted inside the protruding portion 41 when the lightweight aerated concrete layer 10 is wet-deposited. The support member 40 has a predetermined strength to support and maintain the bottom layers 10, 20, and 30 stacked thereon and serves as a mold when the lightweight aerated concrete layer 10 is wet-deposited. That is, the lightweight aerated concrete layer 10 may be deposited directly on the support member 40 without an additional mold. Here, tarpaulin or waterproof vinyl may cover an upper portion of the support member 40, and then the lightweight aerated concrete may be deposited to improve a waterproof performance.

The protruding portion 41 serves to intensify strength of the support member 40 and increase force for supporting a layer disposed on the support member 40. Also, the protruding portion 41 serves to maintain a spaced space between the support member 40 and a lower layer therebelow. This will be described later. Although the protruding portion 41 extends in a transverse direction in the drawings, the extension direction of the protruding portion 41 is not limited thereto. For example, the protruding portion 41 may extend in a longitudinal direction or in both transverse and longitudinal directions.

Also, the support member 40 may be made of a metallic material or made by using a steel sheet. That is, a material that maintains the strength and has a low price may be used. For example, a zinc-coated GI-based steel sheet may be used. Here, the material of the support member 40 is not especially limited as long as the material may maintain the strength and have manufacturability. When the support member 40 is manufactured of the metallic material, enough strength may be secured even with a small thickness. The thickness may be equal to or less than 1 mm. For example the support member 40 may have the thickness of 0.4 mm to 0.5 mm. The support member 40 may be mass-produced by using a construction method such as roll forming and pressing.

The buffer panel 60 may be disposed above the inter-layer separation layer 1 and below the support member 40. The buffer panel 60 absorbs to remove noise or vibration transmitted through the support member 40. The buffer panel may use a sound-absorbing material. The buffer panel 60 may perform an insulation function in addition to the sound absorption. Although a functional synthetic resin material or Styrofoam may be used for the buffer panel 60, the material of the buffer panel 60 is not especially limited as long as the sound absorption function is realized. For example, a general panel selling in the market may be used. The buffer panel 60 may have a plate shape having a predetermined surface area. A plurality of buffer panels may be installed to cover an entire surface area of the inter-layer separation layer 1. The buffer panel 60 may have a thickness enough to remove noise and vibration. The thickness of the buffer panel 60 may be determined in consideration of construction and increase in bottom thickness. For example, the buffer panel 60 may have the thickness of 10 mm to 35 mm.

The damping member 50 is disposed between the inter-layer separation layer 1 and the support member 40 to allow the inter-layer separation layer 1 to be spaced apart from the support member 40. That is, the damping member 50 supports the support member 40 and layers thereabove to hold up the support member 40 and the layers thereabove from the inter-layer separation layer 1, and thus, a height H of the damping member 40 corresponds to a spaced distance between the inter-layer separation layer 1 and the support member 40. The damping member 50 includes a lower plate 52 and an upper plate, which extend in the horizontal direction, and a connecting portion 53 extending in a direction crossing a formation direction of the lower plate 52 and the upper plate (i.e., vertical direction) to connect the lower plate 52 to the upper plate 51. Here, the lower plate 52 of the damping member 50 contacts a portion of the inter-layer separation layer 1, and the upper plate 51 of the damping member 50 contacts a portion of the support member 40. Thus, a height of the connecting portion 53 corresponds to the height of the damping member 40. The connecting portion 53 may extend in a direction perpendicular to the formation direction of the lower plate 52 and the upper plate 51 or in an inclined and crossing direction as illustrated in a partial expanded view of FIG. 1. Although each of the lower plate 52 and the upper plate 51 has a predetermined surface area, the size of each thereof is not especially limited. For example, each of the lower plate 52 and the upper plate 51 may have the size enough to contact and support each layer disposed therebelow and thereabove. For example, the damping member 40 may be manufactured to have a channel shape 50*b* extending in one direction or a clip shape 50*a* having a small area.

The damping member 50 may be disposed on each of edges of the plurality of buffer panels 60. That is, as illustrated in the drawings, the damping member 50 may be disposed on each of plural positions along a side of the buffer panel 60. Here, the upper plate 51 of the damping member 50 may have a top surface contacting a portion of a lower surface of the support member 40 and a bottom surface spaced apart form the top surface of the buffer panel 60, and the connection portion 53 may contact a side surface of the buffer panel 60. Also, the damping member 50 may extend along at least one side, e.g., a side in the longitudinal direction, of the buffer panel 60. Alternatively, the damping members 50 may be spaced apart from each other along at least one side of the buffer panel 60. For example, the damping member 50 may be disposed on each of both ends of the side in the longitudinal direction of the buffer panel 60.

The plurality of damping members 50 are spaced a predetermined distance in a horizontal direction to support each of the upper layers including the support member 40. Here, the number thereof and the distance therebetween are not especially limited as long as the plurality of damping members 50 have the enough strength to maintain the upper layers. Also, the damping member 50 may allow each of the upper supported layers including the support member 40 to be sufficiently spaced apart from the inter-floor separation layer 1 to realize a floating layer structure.

The damping member 50 may be made of a material having strength to support the upper layers and maintain the distance and a vibration-proof material to reduce noise and vibration transmitted from the support member 40. For example, the damping member 50 may be made of all inorganic metal such as aluminum, steel, magnesium, copper, and stainless and alloy steel. Also, the damping member 50 may be made of high manganese vibration-proof steel containing much manganese. Here, the vibration-proof steel may contain 15 wt % to 20 wt % of manganese or 17 wt % of manganese. Also, the damping member 50 may have a height of 10 mm to 40 mm and a thickness of approximately 1.5 mm. For example, without using the buffer panel 60, when the damping member 50 has the height of approximately 10 mm, a distance or a space of approximately 10 mm between the inter-floor separation layer 1 and the support member 40 may be provided. The damping member 50 may be mass-produces through a method of roll forming or pressing. Also, by using the buffer panel 60 and the damping member 50 having the height greater than the thickness of the buffer panel 60, a distance or a space between the buffer panel 60 and the support member 40 may be provided as many as difference between the height of the damping member 50 and the buffer panel 60.

As described above, the damping member 50 allows the inter-floor separation layer 1 and the support member 40 to be spaced apart from each other or the buffer panel 60 and the support member 40 to be spaced apart from each other to define the space, i.e., an air layer A. Referring to FIG. 4, a case when the buffer panel 60 is used is exemplarily described. Since the damping member 50 is supported by the top surface of the inter-floor separation layer 1 and holds up the upper layers (support member and bottom layers) of the damping member 50 to define the space, the air space A is generated. Here, the air layer A has a height D1 obtained by subtracting a thickness T2 of the buffer panel 60 from a height H of the damping member 50. For example, when the damping member 50 has the height H of 35 mm, and the buffer panel 60 has the thickness T2 of 30 mm, the air layer A has the height D1 of 5 mm. Also, since the protruding portion 41 of the support member 40 has a thickness T1 less than the height D1 of the air layer A, a minute distance D2 between the protruding portion 41 of the support member 40 and the buffer panel 60 may be defined to generate an air layer. For example, when the damping member 50 has the height H of 35 mm, the buffer panel 60 has the thickness T2 of 30 mm, and the protruding portion has the height of 4.5 mm, the minute distance D2 corresponds to 0.5 mm. Here, when the upper layer (bottom layer) of the support member 40 has a heavy weight, or downward force is applied at a position spaced greatly from the damping members 50, the support member 40 may be pressed downward, and accordingly, the protruding portion 41 may contact the buffer panel 60. In this case, load of the upper layers is efficiently supported by the protruding portion 41, and the air layer A is still generated between the protruding portions 41. That is, in favor of the simple structure, although the heavy upper layers are provided on the support member 40, the load of the upper layers may be supported and the air layer may be provided.

As described above, the structure including the support member 40 and the damping member 50 to provide the air layer A is effective to block the noise transmitted downward from the upper portion. As the structure of the corrugated support member for sound insulation is applied, the cross-section has a shape capable of supporting deflection due to the load of the upper bottom layer and absorbing the noise generated thereabove and distributing the noise widely and quickly. The air layer below the support member improves a sound insulation function and transmits inter-floor noise generated above the bottom and the load to the damping member. Accordingly, the inter-floor noise may be blocked step by step. That is, a primary inter-floor noise blocking effect is generated in such a manner that the structure of the corrugated support member for sound insulation is applied to provide a path through which the inter-floor noise is firstly transmitted on a path for transmitting the bottom impact noise, and as the transmitted inter-floor noise is transmitted to the damping member, the vibration noise is removed according to the damping structure. An inter-floor noise transmission and removed path may sequentially include the inter-floor noise generation, the corrugated support member, and the damping member (removal). Also, when the buffer panel is inserted, the inter-floor noise may be absorbed and removed by the sound-absorbing material (buffer material) and may not be transmitted to the lower layer. Here, the inter-floor noise transmission and removed path may sequentially include the inter-floor noise generation, the corrugated support member, the air layer, and the damping member (removal).

Hereinafter, various examples of the damping member will be described. FIG. 5 is a perspective view illustrating various examples of the damping member used in an exemplary embodiment.

The size and number of the damping member 50 and the distance between the damping members are designed to have a structure securing durability to suppress the deflection of the support member, which is caused by the load of the upper layers, after the upper structure is installed, and designed to maintain elasticity for generating a damping effect. Also, the damping member 50 is designed to have a shape easily generating the elasticity when stress is generated. As illustrated in FIGS. 1 to 4, the connecting portion may have a cross-section having various shapes including a Z-shape. In addition, various applications having shapes including a clip or a channel may be applied for each applying position. For example, the upper plate and the lower plate of the damping member 50 may be provided in the same direction (refer to b of FIG. 5) or in an opposite direction (refer to a and b of FIG. 5) with respect to the connecting portion. Also, the damping member 50 may have a lengthily extending linear shape and a shape of a piece having a small area. Also, the upper plate and the lower plate of the damping member 50 may have the same area within an error range.

Figure 6:
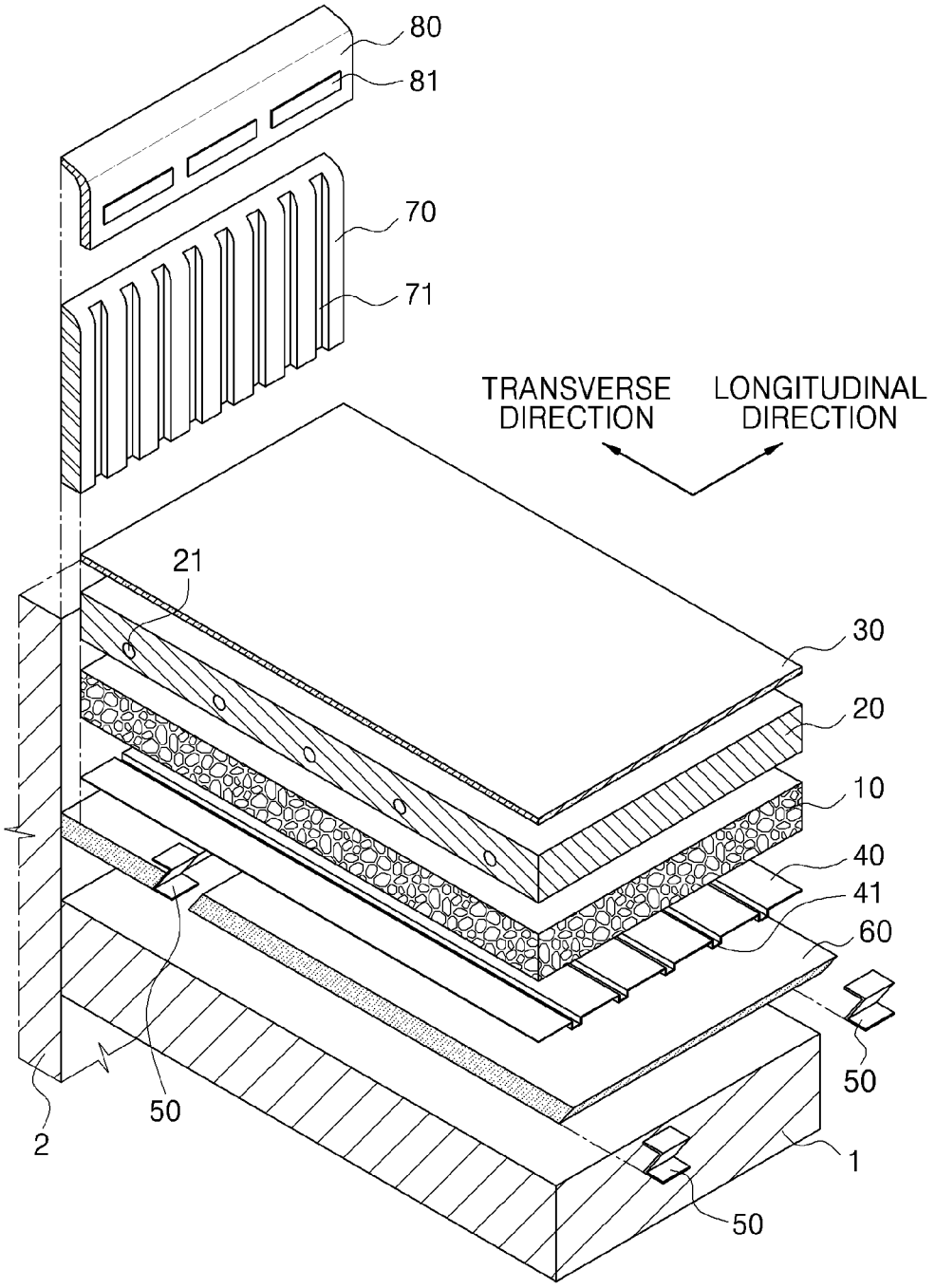
FIGS. 6 and 7 are schematic exploded perspective view and schematic coupling perspective view illustrating a state in which building materials in accordance with another exemplary embodiment are installed in a building.
Figure 7:
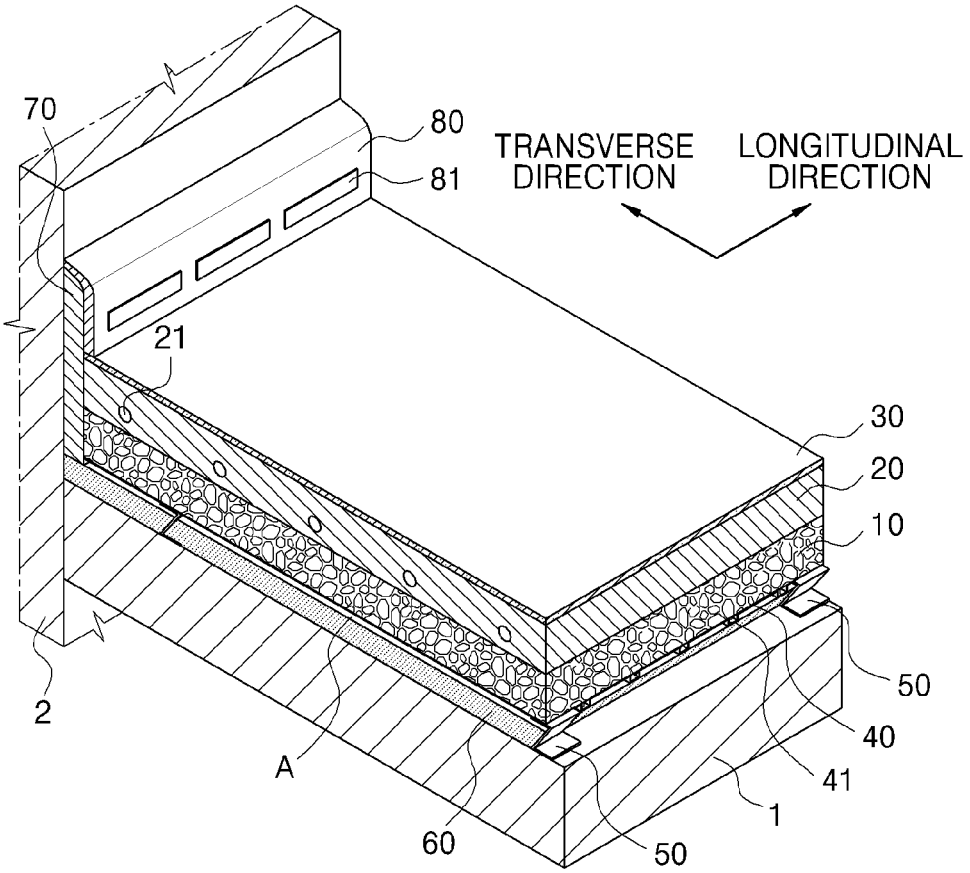

Hereinafter, a building material in accordance with another exemplary embodiment will be described. FIGS. 6 and 7 are schematic exploded perspective view and schematic coupling perspective view illustrating a state the building material in accordance with another exemplary embodiment is disposed on a building. In the present exemplary embodiment, an element for removing noise in a lateral direction in the building material is disposed. Here, the basic structure disposed on the inter-floor separation layer 1 is the same as that of the previous embodiment, and thus the overlapped description for the same elements will be omitted.

The building material in accordance with the present exemplary embodiment includes a side buffer member 70 vertically extending along side surfaces of the support member 40 and the bottom layers 10, 20, and 30 and a washboard 80 disposed to face the side buffer member 70 above the bottom layers 10, 20, and 30.

The side buffer member 70 has a shape of a kind of vertically extending plate and disposed between the sidewall 2 of the building and all sort of layers and members disposed on the inter-floor separation layer 1. The side buffer member 70 includes an air passage 71 vertically extending and having an inner space. That is, the side buffer member 70 includes the air passage 71 vertically extending and recessed toward the sidewall 2. The side buffer member 70 may have a bottom surface contacting the top surface of the inter-floor separation layer 1 or the top surface of the buffer panel 60 and a side surface of which at least a portion contacts the support member 40 and the bottom layers 10, 20, and 30. Also, the side buffer member 70 may be made of a material having a sound absorption function absorbing noise and an insulation function. For example, the side buffer member 70 may be made of the same material as that of the buffer panel 60.

The washing board 80 is a kind of finishing material connected to the sidewall 2, has a vertically extending plate shape, and covers an upper portion of the side buffer member 70. Also, the washing board 80 is connected to the air passage 71 of the side buffer member 70 and includes a discharge passage 81 connected to the outside. The discharge passage 81 may extend in a direction crossing an extension direction of the air passage 71. Accordingly, the air passage 71 of the side buffer member 70 and the discharge passage 81 of the washing board 80 may serve as a sound vent that is a passage through which the noise passes.

An installation order of the building material including the side buffer member 70 and the washing board 80 may be as follows. The installation order may sequentially include inter-layer separation layer 1, the side buffer member 70 and the buffer panel 60, the damping member 50, the support member 40, lightweight aerated concrete layer 10 deposition, heating pipe installation, mortar layer 20 formation, bottom finishing material 30, and the washing board 80. A total thickness after all layers are installed on the inter-floor separation layer 1, i.e., a thickness from the buffer member 70 to the bottom finishing material 30, is from 90 mm to 120 mm.

As described above, as the sound reduction or removal member is disposed even in a direction toward the sidewall 2, the noise may be more efficiently blocked. That is, resonant sound that is not absorbed by the air layer A below the support member 40 may not be transmitted downward and may be discharged to an inside of the upper floor through the side buffer member of a ventilation structure to block the inter-floor transmission sound, and an outer surface of the buffer member may not be exposed because the washing board is disposed thereabove. That is, besides the primary effect of the air layer A, as a secondary blocking effect, the inter-floor noise that is not transmitted along the corrugated support member and transmitted downward is transmitted to the air layer A provided below the support member, and increased inner pressure of the air layer is discharged through the air passage of the side buffer member, thereby being transmitted to an indoor of an occupant who generates the inter-floor noise through a sound vent. Thus the noise may be blocked not to be transmitted to the lower floor. Here, the inter-floor noise transmission and removed path may sequentially include the inter-floor noise generation, the corrugated support member, the air layer, and the sound vent (upward discharge).

The building material in accordance with an exemplary embodiment may reduce, remove, or vent the inter-floor noise through various paths to block most of the inter-floor noise.

Although the present invention has been described with reference to the specific embodiments, it is not limited thereto, and the scope of the present invention is defined by the appended claims. Thus, it is obvious to those skilled in the art that the various changes and modifications can be made in the technical spirit of the present invention.

What is claimed is:

1. A building material that is disposed between an inter-floor separation layer and a bottom layer disposed above the inter-floor separation layer, the inter-floor separation layer being configured to separate two neighboring floors from each other in a building, the building material comprising:

a support member disposed between the inter-floor separation layer and the bottom layer, wherein the support member includes a top surface and a bottom surface, and at least a portion of the top surface contacts the bottom layer;

a protruding portion protruding downwards from the bottom surface of the support member to have a height D, and extending in a direction along and parallel with the bottom surface of the support member; and a damping member disposed between the inter-floor separation layer and the support member, wherein the damping member includes a lower plate contacting the inter-floor separation layer, an upper plate contacting the bottom surface of the support member and a connecting portion connecting the upper plate and the lower plate to each other to allow the inter-floor separation layer to be spaced apart from the support member, and the damping member has a height H defined by the upper plate and the lower plate, the height H being larger than the height D.

2. The building material of claim 1, further comprising: a buffer panel disposed on the inter-floor separation layer between the support member and the inter-floor separation layer, the buffer panel having a thickness T, wherein the damping member is disposed on an edge of the buffer panel.

3. The building material of claim 2, wherein the upper plate has a top surface contacting the bottom surface of the support member, and the connecting portion of the damping member contacts a side surface of the buffer panel.

4. The building material of claim 2, wherein the damping member extends along at least one side of the buffer panel, or the damping member includes a plurality of damping members spaced apart from each other along at least one side of the buffer panel.

5. The building material of claim 2, wherein the height H is greater than a sum of the height D and the thickness T.

6. The building material of claim 2, further comprising:

a side buffer member vertically extending along side surfaces of the support member and the bottom layer above the inter-floor separation layer; and a washing board disposed to face the side buffer member above the bottom layer.

7. The building material of claim 6, wherein the side buffer member comprises an air passage extending in a vertical direction and having an inner space, and the washing board comprises a discharge passage communicatively connected to the air passage and connected to outside.

8. The building material of claim 7, wherein the discharge passage extends in a direction crossing an extension direction of the air passage, and the washing board has an upper end configured to cover an upper portion of the side buffer member.

9. The building material of claim 6, wherein the side buffer member has a bottom surface contacting the top surface of the buffer panel and a side surface of which at least a portion contacts the support member and the bottom layer, and the side buffer member is made of a same material as that of the buffer panel.

10. The building material of claim 1, wherein the upper plate and the lower plate of the damping member are in parallel with each other, and the upper plate and the lower plate of the damping member have a same surface area.

11. The building material of claim 1, wherein the support member comprises a metallic material, and the damping member comprises a material having a vibration-proof function.

12. The building material of claim 1, wherein the support member comprises a steel plate, and the damping member comprises a vibration-proof steel containing manganese.

13. The building material of claim 1, wherein the bottom layer comprises a lightweight aerated concrete layer, and the lightweight aerated concrete layer is wet-deposited on the support member and provided on the top surface and inside the protruding portion of the support member.

14. The building material of claim 1, wherein the height D is 10 mm to 40 mm.

* * * * *